United States Patent [19]

Secemski et al.

[11] Patent Number: 4,564,463

[45] Date of Patent: Jan. 14, 1986

[54] LIQUID LAUNDRY DETERGENTS WITH IMPROVED SOIL RELEASE PROPERTIES

[75] Inventors: Isaac I. Secemski, Flushing, N.Y.; Lynn H. Lander, Harrington Park; Henricus M. Princen, Bedminster, both of N.J.

[73] Assignee: Lever Brothers Company, New York, N.Y.

[21] Appl. No.: 621,289

[22] Filed: Jun. 15, 1984

[51] Int. Cl.[4] ..... C11D 17/00

[52] U.S. Cl. ..... 252/174.17; 252/173; 252/174.19; 252/174.21; 252/553; 252/546; 252/DIG. 14; 252/DIG. 1; 427/393.4

[58] Field of Search ..... 252/540, 559, 534, 553, 252/174.17, 173, DIG. 13, DIG. 14, DIG. 2, DIG. 11, DIG. 15; 427/393.4

[56] References Cited

U.S. PATENT DOCUMENTS

| | | | |
|---|---|---|---|
| 4,000,093 | 12/1976 | Nicol et al. | 252/529 |
| 4,048,433 | 9/1977 | Burns | 536/99 |
| 4,129,515 | 12/1978 | Foster | 252/117 |
| 4,174,305 | 11/1979 | Burns et al. | 252/545 |
| 4,333,862 | 6/1982 | Smith et al. | 252/547 |
| 4,347,168 | 8/1982 | Murphy et al. | 252/547 |
| 4,368,147 | 1/1983 | Inamorato et al. | 252/545 |
| 4,390,466 | 6/1983 | Weinberger | 252/548 |

FOREIGN PATENT DOCUMENTS 1084061 1/1966 United Kingdom .

OTHER PUBLICATIONS

"The Stain Removal Index (SRI): A New Reflectometer Method for Measuring and Reporting Stain Removal Effectiveness", by Neidtich et al., J. Am. Oil Chem. Soc., vol. 57, pp. 426–429 (1980).

*Primary Examiner*—Paul Lieberman
*Assistant Examiner*—John F. McNally
*Attorney, Agent, or Firm*—Milton L. Honig; James J. Farrell

[57] ABSTRACT

A heavy duty liquid detergent composition and a method for imparting soil release benefits to a fabric is herein provided. The composition comprises:

(a) from about 2 to 10% of a nonionic surfactant selected from the group consisting of a $C_{12}$–$C_{13}$ fatty alcohol ethoxylated with an average of 6.5 moles ethylene oxide, a $C_9$–$C_{11}$ fatty alcohol ethoxylated with an average of 6 moles ethylene oxide, and mixtures thereof;

(b) from about 10 to 25% of an anionic surfactant; and (c) from about 0.1 to 0.8% of methylcellulose.

Small amounts of sodium citrate or sodium nitrilotriacetic acid may be present to aid in general detergency.

10 Claims, No Drawings

LIQUID LAUNDRY DETERGENTS WITH IMPROVED SOIL RELEASE PROPERTIES

BACKGROUND OF THE INVENTION

1. Field of the Invention

The invention relates to heavy duty liquid detergents with improved soil release properties comprising a mixed surfactant system and particular nonionic surfactants and levels of builder.

2. The Prior Art

Cellulose ether polymers have long been used in liquid laundry detergents. They improve the product's physical and performance properties. When present, cellulose ether polymers are known to deposit on clothing during the wash cycle. The polymers impart a degree of hydrophilicity to hydrophobic fabrics such as polyester. Surface modification results in improved removal of hydrophobic oily soils is subsequent washes. The property resulting from this process is known as soil release.

Soil release benefits derived from cellulose ethers will depend markedly on various formulation parameters. The art has, heretofore, not defined the influence that specific liquid detergent ingredients have upon soil release performance. Compositions delivering improved performance in this area of cleaning have been sought after.

Accordingly, it is the prime object of this invention to provide a heavy duty liquid laundry detergent that provides improved soil release benefits.

SUMMARY OF THE INVENTION

A heavy duty liquid detergent composition with improved soil release properties is provided comprising:

(a) from about 2 to 10% of a nonionic surfactant selected from the group consisting of a $C_{12}$–$C_{13}$ fatty alcohol ethoxylated with an average of 6.5 moles ethylene oxide, a $C_9$–$C_{11}$ fatty alcohol ethoxylated with an average of 6 moles ethylene oxide, and mixtures thereof;

(b) from about 10 to 25% of an anionic surfactant; and (c) from about 0.1 to 0.8% of methylcellulose.

DETAILED DESCRIPTION OF THE INVENTION

It has been discovered that by selecting particular nonionic surfactants and restricting the amount and type of builder, soil release can be enhanced without harming the products' physical stability. The benefits are particularly evident at low wash temperatures.

The invention is directed at two particular nonionic surfactants. These are a $C_{12}$–$C_{13}$ fatty alcohol ethoxylated with an average of 6.5 moles ethylene oxide and a $C_9$–$C_{11}$ fatty alcohol ethoxylated with an average of 6 moles ethylene oxide. These surfactants are commercially available from the Shell Chemical Company under the designation Neodol TM 23-6.5 and Neodol TM 91-6, respectively. These surfactants are present in the formulation from about 2% to 10% by weight, preferably from about 6% to 7%.

While many cellulose ethers are known, the present invention is directed at methylcellulose ethers. These polymers are commercially available in a variety of viscosities, molecular weights and degrees of substitution. Particularly preferred is a methylcellulose sold by the Dow Chemical Company as Methocel A TM. The material has a methoxyl degree of substitution ranging from 1.64 to 1.92 and methoxyl content of 27.5 to 31.5%. Methylcellulose ethers are present in an amount from about 0.1 to 0.8% by weight of the liquid detergent composition; preferably from about 0.3 to 0.5%.

The liquid detergent systems of this invention are directed at mixed anionic-nonionic surfactant compositions. A wide variety of anionic surfactants may be utilized. Anionic synthetic detergents can be broadly described as surface active compounds with negatively charged functional group(s). An important class of compounds within this category are the water-soluble salts, particularly the alkali metal salts, of organic sulfur reaction products having in their molecular structure an alkyl radical containing from about 8 to about 22 carbon atoms and a radical selected from the group consisting of sulfonic acid and sulfuric acid esters radicals. Such surfactants are well known in the detergent art and are described at length in "Surface Active Agents and Detergents", Vol. II, by Schwartz, Perry & Berch, Interscience Publishers Inc., 1958, herein incorporated by reference.

Particularly suitable anionic surfactants for the instant invention are the higher alkyl mononuclear aromatic sulfonates. They contain from 10 to 16 carbon atoms in the alkyl chain. Alkali metal, ammonium or alkanolammonium salts of these sulfonates are suitable, although the sodium salts are preferred. Specific examples include: sodium linear tridecyl benzene sulfonate; sodium linear pentadecyl benzene sulfonate; and sodium p-n-dodecyl benzene sulfonate. These anionic surfactants are present usually from about 10 to about 25% by weight of the total composition. Preferably, they are present from 15 to 20%.

The compositions of this invention may contain the detergent builders sodium citrate, sodium nitrilotriacetate or mixtures. They may be present in an amount of from about 2 to 10% by weight; preferably about 5 to 8%. Greater levels than the stated amounts of these builders, will adversely affect soil release properties. Amounts substantially less than 5%, will adversely affect general detergency and pretreatment cleaning.

The presence of a hydrotrope within the composition is highly desirable. Hydrotropes are substances that increase the solubility in water of another material which is only partially soluble. Preferred hydrotropes are the alkali metal, ammonium or alkanolammonium salts of benzene sulfonic acid, toluene sulfonic acid and xylene sulfonic acid. These hydrotropes may be present from about 1% to about 15% by weight of the total composition; preferably from about 2% to about 10%.

Fatty ($C_{12}$–$C_{20}$) acids such as stearic or coconut fatty acids may be employed with the instant compositions as lather depressants. The fatty acids may be present from about 0.01% to about 1.0% by weight of the total composition.

The compositions may contain all manner of minor additives commonly found in such liquid detergents and in amounts in which such additives are normally employed. Examples of these additives include: lather boosters, oxygen or chlorine-releasing bleaching agents, fabric softening agents, inorganic salts and buffering agents. Usually present in very minor amounts are fabric whitening agents, perfumes, enzymes, preservatives, opacifiers and colorants.

Soil Release Evaluation Test Procedure

In the method of testing for soil release, both 100% polyester single knit and (65/35) polyester/cotton permanent press test pieces are evaluated. These fabrics are washed at 130° F. in a suitable detergent (one delivering no soil release benefit) to remove spinning oils and to "wear" the fabric. The test pieces are then prewashed in test product (to impart a soil shield), stained and washed once again. Thereafter, the level of stain remaining on the fabric is evaluated using percent detergency values or Stain Removal Index (SRI) as the measure of performance. An article by Neiditch et al, J. Amer. Oil Chem. Soc., Vo. 57, pages 426–429 (1980) describes the test method for determining SRI, and is herein incorporated by reference. In addition to instrumental evaluation, the wash clothes are visually rated.

The following examples will more fully illustrate the embodiments of this invention. All parts, percentages and proportions referred to herein and in the appended claims are by weight unless otherwise indicated.

EXAMPLE 1

Evaluations of various alcohol ethoxylate nonionics were performed using the base formulation described by Table I.

TABLE I

| Base Composition | |
|---|---|
| Components | Weight % |
| Sodium alkylbenzene sulfonate | 17 |
| Alcohol ethoxylate | 7 |
| Sodium xylene sulfonate | 3 |
| Sodium citrate dihydrate | 5 |
| Monoethanolamine | 2 |
| Methylcellulose | 0.5 |
| Colorant, fabric brightener, perfume, soap and opacifier | 1.3 |
| Water | up to 100 |

EXAMPLE 2

The effect of changing nonionic surfactant type on soil release of dirty motor oil (DMO) was herein evaluated. Unsoiled polyester fabrics were prewashed twice in water containing the detergent formulation of Table I having various Neodol TM surfactants as outlined in Table II. Thereafter, the fabrics were stained with DMO, washed with the same detergent, and evaluated for percent detergency.

TABLE II

Soil Release of DMO From Prewash (2×) Polyester at 100° F.

| Neodol TM Nonionic | Neodol TM Identity | HLB | Percent Detergency 150 ppm | 180 ppm | 210 ppm |
|---|---|---|---|---|---|
| 23-6.5 | $C_{12-13}$ alcohol/6.5 E.O. | 12.0 | 17.8 | 41.2 | 62.9 |
| 45-7 | $C_{14-15}$ alcohol/7 E.O. | 12.0 | 7.7 | 15.3 | 18.0 |
| 25-7 | $C_{12-15}$ alcohol/7 E.O. | 12.2 | 7.2 | 23.8 | 33.4 |
| 91-6 | $C_{9-11}$ alcohol/6 E.O. | 12.5 | 31.9 | 68.9 | 65.3 |
| 25-9 | $C_{12-15}$ alcohol/9 E.O. | 13.3 | 7.3 | 17.7 | 28.7 |
| 45-13 | $C_{14-15}$ alcohol/13 E.O. | 14.4 | 13.6 | 32.2 | 36.7 |

It is clear from the Table that Neodol TM 91-6 and 23-6.5 perform substantially better than the other nonionics at all water hardnesses tested. The results are surprising since there does not appear to be a clear correlation of benefit with HLB values. Note in particular the marked difference in performance between Neodol TM 25-7 and 23-6.5, two nonionics with similar physical and chemical properties.

EXAMPLE 3

The soil release process can be divided into two steps: (1) a pre-wash wherein cellulose ether is deposited onto the fabric surface; and (2) a final wash where soil is deterged from the fabric. Experiments were performed to better understand the effects of different nonionic surfactants in each of these steps. In one set of experiments (A), cloths were prewashed in formulations containing various nonionics followed by final wash in a Neodol TM 25-9 containing detergent composition. Set A demonstrated the effect each nonionic type had upon the cellulose ether deposition onto fabric. A second set of experiments (B) reversed the order of nonionic treatment. Set B demonstrated the effect each nonionic type had upon the oily soil removal from the fabric surface. Results are presented in Table III.

TABLE III

Soil Release of DMO from Prewashed (2×) Polyester at 100° F. (Hardness of 180 ppm)

| Pre-wash in Product with Neodol TM | Final Wash in Product with Neodol TM | % Detergency |
|---|---|---|
| | Set A | |
| 23-6.5 | 25-9 | 37.9 |
| 45-7 | " | 36.6 |
| 25-7 | " | 30.2 |
| 91-6 | " | 55.8 |
| 25-9 | " | 27.9 |
| 45-13 | " | 68.2 |
| | Set B | |
| 25-9 | 23-6.5 | 42.5 |
| " | 45-7 | 18.7 |
| " | 25-7 | 32.5 |
| " | 91-6 | 47.7 |
| " | 25-9 | 34.0 |
| " | 45-13 | 24.3 |

These results show that overall superiority of Neodol TM 91-6 and 23-6.5 is due to a combination of both effective deposition of cellulose ether and removal of oily soil from fabrics. In contrast, nonionics such as Neodol TM 45-13 give excellent cellulose ether deposition but poor oily soil removal. Nonionics such as Neodol TM 25-7 and 25-9 give adequate oily soil removal but poorer cellulose ether deposition.

It is noteworthy that there is no clear effect of HLB on either the cellulose ether deposition (compare Neodols TM 45-13, 25-9 and 91-6) or oily soil removal (compare Neodols TM 45-7, 91-6, 25-9 and 45-13).

EXAMPLE 4

Builder level can affect the soil release benefit. Three citrate levels were prepared using the base formulation of Table I and 7% Neodol 25-9. These compositions were evaluated for soil release of dirty motor oil (DMO) and of achiotina sauce and creosote. Tables IV and V reveal that as the citrate level decreases below 10%, soil release improves as shown by statistically significantly higher SRI values. There is also a visually perceivable improvement in soil release as builder level decreases.

TABLE IV

Soil Release of DMO from Prewashed (1×) Polyester (at 100° F., 100 ppm hardness)

| Sodium Citrate (Wt. %) | Stain Removal Index (SRI) |
|---|---|
| 10 | 60.3 |
| 5 | 74.3 |

TABLE IV-continued

| Soil Release of DMO from Prewashed (1×) Polyester (at 100° F., 100 ppm hardness) | |
|---|---|
| Sodium Citrate (Wt. %) | Stain Removal Index (SRI) |
| 0 | 90.1 |

TABLE V

| Soil Release from Prewashed (2×) Polyester and 65/35 Polyester/Cotton (at 90° F., 60 ppm hardness) | | | | |
|---|---|---|---|---|
| Sodium | Achiotina Sauce | | Creosote | |
| Citrate (Wt. %) | Polyester | Polyester/ Cotton | Polyester | Polyester/ Cotton |
| 10 | 81.6 | 65.5 | 67.4 | 49.4 |
| 0 | 88.7 | 75.8 | 74.7 | 57.5 |

Similar formulations were prepared substituting sodium chloride or sulfate for sodium citrate to demonstrate that the above results are not attributable to changes in ionic strength. Soil release evaluations on polyester cloths washed in these compositions are presented in Table VI.

TABLE VI

| Soil Release of DMO From Prewashed (2×) Polyester (at 100° F., 120 ppm hardness) | |
|---|---|
| Electrolyte | Percent Detergency |
| 10% sodium citrate | 16.7 |
| 0% sodium citrate | 73.4 |
| 10% sodium sulfate | 59.1 |
| 3% sodium sulfate | 70.6 |
| 8% sodium chloride | 56.1 |
| 5% sodium chloride | 65.0 |

The results in Table VI reveal a slight decrease in soil release as level of non-building electrolyte increases. However, the increase is small when compared to the major changes observed when the sodium citrate level is altered.

EXAMPLE 5

Although soil release in these systems benefits from a reduced level of builders, soil release is only one of several performance aspects. Others include general detergency and pretreatment, both of which are adversely affected by a decrease in level of builder.

To demonstrate the adverse effects of 0% citrate, the formulations of Table IV were evaluated for general detergency on vacuum cleaner dust (VCD) and Lever Clay soil cloths. Detergency and pretreatment results are set forth in Tables VIII and IX, respectively. The results demonstrate the importance of incorporating at least small amounts of citrate builder into the formulation. Detergency differences were significant both visually and instrumentally between cloths washed in zero level citrate compositions and those containing 5 or 10% builder.

TABLE VIII

| Effect of Sodium Citrate Level on Detergency of Lever Clay and VCD Test Cloths* | | | | | | |
|---|---|---|---|---|---|---|
| | Percent Detergency | | | | | |
| | VCD | | | Lever Clay | | |
| Sodium Citrate (Wt. %) | 60 ppm | 120 ppm | 180 ppm | 60 ppm | 120 ppm | 180 ppm |
| 10 | 34.1 | 24.5 | 21.0 | 51.4 | 46.2 | 46.1 |
| 5 | 32.0 | 21.8 | 20.6 | 50.0 | 46.7 | 43.9 |
| 0 | 23.4 | 18.9 | 18.0 | 47.6 | 45.1 | 44.3 |

TABLE VIII-continued

| Effect of Sodium Citrate Level on Detergency of Lever Clay and VCD Test Cloths* | | | | | | |
|---|---|---|---|---|---|---|
| | Percent Detergency | | | | | |
| | VCD | | | Lever Clay | | |
| Sodium Citrate (Wt. %) | 60 ppm | 120 ppm | 180 ppm | 60 ppm | 120 ppm | 180 ppm |
| Least Significant Difference (95% Confidence Level) | 1.5 | 1.6 | 1.2 | 1.5 | 1.1 | 0.7 |

*Dosage 0.21% at 100° F.

TABLE IX

| DMO Pretreatment on W.I.R.A. Abrasion Tester | | |
|---|---|---|
| | SRI | |
| Sodium Citrate (Wt. %) | 65/35 Polyester cotton p.p. | 100% S/K Polyester |
| 10 | 77.2 | 57.0 |
| 0 | 64.4 | 51.2 |

WIRA PRETREATMENT PERFORMANCE TEST ON DIRTY MOTOR OIL (DMO) STAINS

The WIRA pretreatment performance test to evaluate the pretreatment efficacy of a test formulation was done on DMO (dirty motor oil) stained polyester and cotton/polyester test swatches measuring 4½"×9".

The test swatches were stained with dirty motor oil in a two-inch circular area and aged for one hour. Afterwards, they were mounted on the plates of a WIRA (Wool Industries Research Association) abrasion tester. One teaspoon of a liquid test formulation was then placed on the stained area of each respective swatch. The WIRA abrasion machine then performed the pretreatment evaluation by brushing the test-formulation on the stained area for some pre-determined number of strokes (e.g. 48). After the pretreatment, test swatches were rinsed in tap water for one minute in a washing machine and static dried. The % reflectance of each test swatch was then determined by means of a Gardner reflectometer.

EXAMPLE 6

Soil release is improved both by selection of preferred nonionics, Neodol TM 91-6 or Neodol TM 23-6.5, and by restricting the level of builder. A combination of both these formulation modifications resulted in enhanced soil release, particularly at low wash temperatures. This can be seen from the data in Table X. Therein are compared a formulation containing Neodol TM 25-9 and 10% sodium citrate with one containing preferred Neodol TM 23-6.5 and 5% sodium citrate. The latter composition uses 5% citrate as a compromise level that delivers enhanced soil release without major reduction in general detergency and pretreatment. SRI differences between the two compositions were statistically significant and visually perceivable.

TABLE X

| Soil Release from Prewashed (1×) Polyester* | | | | | |
|---|---|---|---|---|---|
| | | Stain Removal Index | | | |
| Sodium Citrate (Wt. %) | Nonionic** | DMO | Wes-son Oil | Achiotina Sauce | Spa-ghetti Sauce |
| 5 | Neodol TM 23-6.5 | 93.5 | 97.9 | 85.5 | 95.3 |

TABLE X-continued

| Soil Release from Prewashed (1×) Polyester* | | | | | |
|---|---|---|---|---|---|
| | | Stain Removal Index | | | |
| Sodium Citrate (Wt. %) | Nonionic** | DMO | Wes-son Oil | Achiotina Sauce | Spa-ghetti Sauce |
| 10 | Neodol TM 25-9 | 76.7 | 79.5 | 74.8 | 92.4 |

*The DMO stained polyester was washed at 100° F., 150 ppm, and cloths with other stains at 70° F., 60 ppm.
**At 7 wt. % level.

The foregoing description and examples illustrate selected embodiments of the present invention and in light thereof variations and modifications will be suggested to one skilled in the art, all of which are in the spirit and purview of this invention.

What is claimed is:

1. A heavy duty liquid detergent composition with improved soil release properties comprising:
   (a) from about 2 to 10% of a nonionic surfactant selected from the group consisting of a $C_{12}$–$C_{13}$ fatty alcohol ethoxylated with an average of 6.5 moles ethylene oxide, a $C_9$–$C_{11}$ fatty alcohol ethoxylated with an average of 6 moles ethylene oxide, and mixtures thereof;
   (b) from about 10 to 25% of an anionic surfactant; and
   (c) from about 0.1 to 0.8% of methylcellulose.

2. A composition according to claim 1 further comprising from about 2 to 10% of sodium citrate or sodium nitrilotriacetic acid.

3. A composition according to claim 1 wherein the nonionic surfactant is present from about 6 to 7%.

4. A composition according to claim 1 wherein the anionic surfactant is the salt of a linear alkylbenzene sulfonate whose alkyl radical has from 8 to 22 carbon atoms and having a cation selected from the group consisting of alkali metal; ammonium; mono-, di- and tri-ethanolammonium ions.

5. A composition according to claim 1 wherein the methylcellulose is present from about 0.3 to 0.5%.

6. A composition according to claim 1 wherein the methylcellulose has a methoxyl degree of substitution ranging from 1.64 to 1.92 and methoxyl content of 27.5 to 31.5%.

7. A composition according to claim 1 further comprising a hydrotrope selected from the group consisting of alkali metal or ammonium salts of xylene-, toluene-, ethyl benzene- and isopropyl benzene-sulfonates and mixtures thereof.

8. A composition according to claim 1 further comprising from about 0.01 to 1.0% of $C_{12}$–$C_{20}$ fatty acid.

9. A method for imparting soil release benefits to a fabric comprising washing the fabric with a liquid detergent composition comprising:
   (a) from about 2 to 10% of a nonionic surfactant selected from the group consisting of a $C_{12}$–$C_{13}$ fatty alcohol ethoxylated with an average of 6.5 moles ethylene oxide, a $C_9$–$C_{11}$ fatty alcohol ethoxylated with an average of 6 moles ethylene oxide, and mixtures thereof;
   (b) from about 10 to 25% of an anionic surfactant; and
   (c) from about 0.1 to 0.8% of methylcellulose.

10. A method according to claim 9 wherein the detergent composition further comprises from about 2 to 10% of sodium citrate and sodium nitrilotriacetate acid.

* * * * *